US005616456A

United States Patent [19]

Oya et al.

[11] Patent Number: 5,616,456

[45] Date of Patent: Apr. 1, 1997

[54] SILVER HALIDE PHOTOGRAPHIC MATERIAL

[75] Inventors: Toyohisa Oya; Takahiro Goto, both of Kanagawa, Japan

[73] Assignee: Fuji Photo Film Co., Ltd., Kanagawa, Japan

[21] Appl. No.: 604,480

[22] Filed: Feb. 21, 1996

[30] Foreign Application Priority Data

Feb. 22, 1995 [JP] Japan ..... 7-034029

[51] Int. Cl.[6] ..... G03C 1/22

[52] U.S. Cl. ..... 430/581; 430/592

[58] Field of Search ..... 430/581, 592

[56] References Cited

U.S. PATENT DOCUMENTS 4,266,003 5/1981 Ikeda et al. ..... 430/264

4,513,081 4/1985 Okazaki et al. ..... 430/592

FOREIGN PATENT DOCUMENTS 800244 8/1958 United Kingdom ..... 430/592

*Primary Examiner*—Lee C. Wright

*Attorney, Agent, or Firm*—Sughrue, Mion, Zinn, Macpeak & Seas

[57] ABSTRACT

A silver halide photographic material containing a methine compound containing a thiohydantoin ring substituted by a pyrazinyl group at the 3-position, which has high sensitivity, high reproducibility, good storage stability, and leaves hardly color on unexposed areas after being processed. Example General formula:

wherein Z represents a group of atoms necessary to form a five- or six-membered nitrogen-containing heterocyclic ring; $R_1$ represents an alkyl group; $R_2$ represents a hydrogen atom, an alkyl group, an alkenyl group, an aryl group, or a heterocyclic group; $R_3$ represents a pyrazinyl group; $L_1$ and $L_2$ each represents a methine group; and n represents 0 or an integer of 1 to 3.

5 Claims, No Drawings

SILVER HALIDE PHOTOGRAPHIC MATERIAL

FIELD OF THE INVENTION

The present invention relates to a silver halide photographic material which is spectrally sensitized by a novel merocyanine dye, and particularly, to a superhigh-contrast silver halide photographic material used for a photomechanical process.

BACKGROUND OF THE INVENTION

In the field of a photomechanical process, photographic materials having good capability to reproduce originals, stabilized processing solutions and simplified replenishment have been required to cope with variety and complexity of printing matter.

Particularly, line originals used for a line camera work are usually made by pasting phototypesetting letters, handwriting letters, illustrations, halftone photographs, and so forth. That is, images which are different in density and line width coexist in an original. Therefore, process cameras, photographic materials, and methods of image formation to make it possible to faithfully reproduce such an original have been urgently demanded. On the other hand, enlargement (spread) or reduction (choke) of halftone photographs is widely carried out for platemaking for catalogs or large-sized posters. The platemaking involving the enlargement of halftone dots brings about coarse screen ruling, resulting in photographing of out-of-focus dots, whereas the reduction brings about minute screen ruling per inch, resulting in photographing smaller dots. Methods of image formation which have a broader latitude has been accordingly required to maintain the capability to reproduce halftone gradation.

A method for obtaining a line drawing or halftone image having high contrast and high blacking density in which the difference between image areas and nonimage areas are clearly distinguished by processing a silver halide photographic material of a lithographic type containing at least 50% or more of silver chlorobromide with a hydroquinone-based developer having a very low effective concentration of sulfite ion (usually 0.1 mol/liter or less) is known as a system satisfying the demand for the broader latitude. However, in this method, the developer is very unstable to air oxidation, and various attempts have been made to keep stable activity of the developer on continuous use.

To solve such instability in image formation, a system of image formation which can ensure superhigh-contrast photographic characteristics by developing with a processing solution having good storage stability have been required. One of such systems is proposed in U.S. Pat. No. 4,166,742, which can form a superhigh-contrast negative image having $\gamma$ exceeding 10 by processing a silver halide photographic material of a surfacelatent image type containing a certain acylhydrazine compound with a developer of pH 11.0 to 12.3 which contains sulfite ion as a preservative. This system of image formation has performances excellent in sharpness of halftone quality, processing stability, rapidity, and capability to reproduce an original.

However, the developer used for this system of image formation has the disadvantage of being liable to fog, because the developer has to keep relatively high pH to obtain high contrast. To control the fogging, a technique for improving significantly image quality by adding a redox compound which is oxidized to release a development inhibitor is disclosed in JP-A-61-213847 (The term "JP-A" as used herein means an "unexamined published Japanese patent application").

On the other hand, some kinds of merocyanine dyes are known to be used as spectral sensitizing dyes for photographic emulsion as disclosed in U.S. Pat. Nos. 3,480,439 and 3,625,698, and so forth. Examples of sensitizing dyes having characteristics which give a hard and sharp halftone image include dimethinemerocyanine dyes containing a thiohydantoin ring substituted by a pyridyl group disclosed in JP-A-55-45015 corresponding to U.S. Pat. No. 4,266,003; and dimethinemerocyanine dyes containing a thio-hydantoin ring substituted by a phenyl group disclosed in JP-B-54-34532 (The term "JP-B" as used herein means an "examined Japanese patent publication"). However, the silver halide photographic materials containing such merocyanine dyes, in fact, have the disadvantage of low sensitivity, low contrast and deteriorated storage stability, or of being liable to leave color on the materials after being processed. Thus, the advent of spectral sensitizing dyes which do not have such drawbacks has been urgently expected.

SUMMARY OF THE INVENTION

An object of the present invention is to provide a silver halide photographic material of high quality which has high sensitivity, high contrast and good storage stability. Another object of the present invention is to provide a silver halide photographic material on which color is hardly left after being processed.

As a result of intensive studies, the above-mentioned objects of the present invention have been achieved by the following means.

A silver halide photographic material comprising at least one of compounds represented by general formula (I):

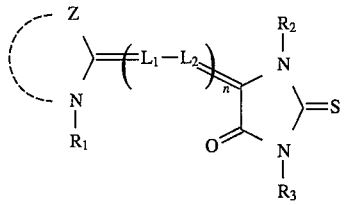

(I)

wherein Z represents a group of atoms which is necessary to form a five- or six-membered nitrogen-containing heterocylic ring; $R_1$ represents an alkyl group; $R_2$ represents a hydrogen atom, an alkyl group, an alkenyl group, an aryl group, or a heterocyclic group; $R_3$ represents a pyrazinyl group; $L_1$ and $L_2$ each represents a methine group; and n represents 0 or an integer of 1 to 3.

DETAILED DESCRIPTION OF THE INVENTION

General formula (I) is described below in more detail.

Groups represented by $R_1$ which are preferably used are an unsubstituted alkyl group having 1 to 18, and preferably 2 to 10 carbon atoms (for example, methyl, ethyl, n-propyl, isopropyl, n-butyl, n-pentyl, n-hexyl, n-octyl, ndecyl, n-dodecyl, and n-octadecyl) and a substituted alkyl group. $R_1$ may combine with a methine group represented by $L_1$ and $L_2$ to form a ring. Examples of the substituent groups for the alkyl group include a carboxyl group, a sulfo group, a cyano group, a halogen atom (for example, fluorine, chlorine, bromine, and iodine), a hydroxyl group, an alkoxycarbonyl group having 2 to 10, and preferably 2 to 8 carbon atoms (for example, methoxycarbonyl, ethoxycarbonyl and benzyloxycarbonyl), an alkoxyl group having 1 to 16, and preferably 1 to 8 carbon atoms (for example, methoxy, ethoxy, benzyloxy, and phenetyl-oxy), an aryloxy group having 6 to 12, and preferably 6 to 10 carbon atoms (for example, phenoxy and p-tolyloxy), an acyloxy group having 2 to 6, and preferably 2 to 4 carbon atoms (for example, acetyloxy and propionyloxy), an acyl group having 2 to 12, and preferably 2 to 8 carbon atoms (for example, acetyl, propionyl, benzoyl, and mesyl), a carbamoyl group having 1 to 10, and preferably 1 to 5 carbon atoms (for example, carbamoyl, N,N-dimethylcarbamoyl, morpholino-carbonyl, and piperidinocarbonyl), a sulfamoyl group having 0 to 10, and preferably 0 to 5 carbon atoms (for example, sulfamoyl, N,N-dimethylsulfamoyl, morpholinosulfonyl, and piperidinosulfonyl), and an aryl group having 6 to 18, and preferably 6 to 10 carbon atoms (for example, phenyl, 4-chlorophenyl, 4-methylphenyl, and α-naphthyl). Groups represented by $R_1$ which are particularly preferably used are an unsubstituted alkyl group (for example, methyl, ethyl, n-propyl, and n-butyl), a carboxyalkyl group (for example, 2-carboxyethyl and carboxymethyl), a sulfoalkyl group (for example, 2-sulfoethyl, 3-sulfopropyl, 4-sulfobutyl, and 3-sulfobutyl), and a methanesulfonylcarbamoylmethyl group.

The five- or six-membered nitrogen-containing heterocycles which are completed by Z may further be fused together with another ring; may be saturated or unsaturated; and, in addition to a nitrogen atom, may contain an oxygen atom, a sulfur atom, a selenium atom, or a tellurium atom as a heteroatom. Examples of preferred heterocycles include a benzothiazole nucleus, a benzoxazole nucleus, a benzoselenazole nucleus, a benzotellurazole nucleus, a 2-quinoline nucleus, a 4-quinoline nucleus, an isoquinoline nucleus, a pyridine nucleus, an indolenine nucleus, a benzimidazole nucleus, a naphthothiazole nucleus, a naphthoxazole nucleus, a naphthoselenazole nucleus, a naphthotellurazole nucleus, a naphthoimidazole nucleus, an oxazole nucleus, a thiazoline nucleus, a selenazoline nucleus, a indoline nucleus, an oxazoline nucleus, an oxadiazole nucleus, a thiadiazole nucleus, a tetrazole nucleus, a thiazole nucleus, a selenazole nucleus, an imidazole nucleus, an imidazo[4,5-b]quinoxaline nucleus, and a pyrimidine nucleus. Examples of more preferred heterocycles include an oxazole nucleus, a benzoxazole nucleus, a naphtho[1,2-d]oxazole nucleus, a naphtho[2,1-d]oxazole nucleus, a naphtho[2,3-d] oxazole nucleus, an oxazoline nucleus, and a thiazoline nucleus. A particularly preferred heterocycle is a benzoxazole nucleus. These nitrogen-containing heterocycles may contain a substituent group, examples of which include a halogen atom (for example, fluorine, chlorine and bromine), an unsubstituted alkyl group having 1 to 12, and preferably 1 to 6 carbon atoms (for example, methyl, ethyl, n-propyl, isopropyl, n-butyl, and n-hexyl), an alkoxyl group having 1 to 6, and preferably 1 to 4 carbon atoms (for example, methoxy, ethoxy, propoxy, and isopropoxy), a hydroxyl group, an alkoxycarbonyl group having 2 to 12, and preferably 2 to 5 carbon atoms (for example, methoxycarbonyl and ethoxycarbonyl), an alkylcarbonyloxy group having 2 to 10, and preferably 2 to 5 carbon atoms (for example, acetyloxy and propionyloxy), a phenyl group, a hydroxyphenyl group, a group which simultaneously contains an amido group having 3 to 15, and preferably 5 to 10 carbon atoms and an aromatic ring (for example, p-acetylaminophenyl, m-acetylaminophenyl, 2-pyrrolecaroxyamido, m-hydroxybenzamido, 2,6-dihydroxybenzamido, 2-furancarboxyamido, and 2-thiophenecarboxyamido), a furyl group, and a pyrrolyl group.

$R_2$ represents a hydrogen atom, an unsubstituted or substituted alkyl group, an unsubstituted or substituted alkenyl group having 3 to 12, and preferably 3 to 8 carbon atoms (for example, allyl and 2-methylallyl), an unsubstituted or substituted aryl group having 5 to 12 carbon atoms (for example, phenyl, tolyl, m-cyanophenyl, and p-hydroxyphenyl), or a heterocyclic group having 1 to 15 carbon atoms (for example, 2-thiazolyl, 2-furyl, 2-pyrazolyl and 2-pyridyl). Examples of preferred unsubstituted alkyl groups include a methyl group, an ethyl group, a propyl group, and a butyl group, and among these, an ethyl group is more preferably used. Examples of the substituted alkyl group include an alkoxycarbonylalkyl group having 3 to 12, and preferably 3 to 7 carbon atoms (for example, methoxycarbonylmethyl, ethoxycarbonylmethyl and ethoxycarbonylethyl), a hydroxyalkyl group having 1 to 6, and preferably 1 to 4 carbon atoms (for example, 2-hydroxyethyl, 2-hydroxypropyl, 3-hydroxypropyl, and 2,3-dihydroxypropyl), a hydroxyalkoxyalkyl group having 2 to 10, and preferably 2 to 6 carbon atoms [for example, a hydroxymethoxymethyl, 2-(2-hydroxyethoxy)ethyl and 2-hydroxyethoxyethyl), a carbamoylalkyl group having 2 to 12, and preferably 2 to 8 carbon atoms which includes N-alkyl-substituted, N,N-dialkyl substituted, N-hydroxyalkyl-substituted, N-alkyl-N-hydroxyalkyl-substituted, or N,N-di(hydroxyalkyl)-substituted carbamoylalkyl groups and five- and six-membered cyclic amine-based carbamoylalkyl groups (for example, 2-carbamoylethyl, 2-N-(2-hydroxyethyl)-carbamoylethyl, N,N-di(2-hydroxyethyl)carbamoylmethyl, N,N-di(2-hydroxyethyl)carbamoylethyl, N,N-dimethylcarbamoylmethyl, morpholinocarbamoylmethyl, and piperidinocarbamoylmethyl], a hydroxyphenyl group (for example, o-hydroxyphenyl, p-hydroxyphenyl and 2,6-dihydroxyphenyl), and a hydroxyalkylphenyl group having 7 to 9 carbon atoms [for example, p-(2-hydroxyethyl)phenyl and m-(1-hydroxyethyl)phenyl]. Among these, a hydroxyethyl group and a 2-(2-hydroxyethoxy)ethyl group are particularly preferably used.

$R_3$ represents an unsubstituted or substituted pyrazinyl group, and may further be fused together with another ring. A substituent group on a pyrazine ring may attach to either a carbon atom or a nitrogen atom which constitutes the ring. Examples of substituent groups on the carbon atom include a halogen atom (for example, fluorine, chlorine and bromine), an unsubstituted alkyl group having 1 to 6, and preferably 1 to 3 carbon atoms (for example, methyl, ethyl and propyl), an alkoxyl group having 1 to 8, and preferably 1 to 4 carbon atoms (for example, methoxy, ethoxy, propoxy, and iso-propoxy), a hydroxyl group, an alkoxycarbonyl group having 2 to 8, and preferably 2 to 5 carbon atoms (for example, methoxycarbonyl and ethoxycarbonyl), an alkylcarbonyloxy group having 2 to 8, and preferably 2 to 4 carbon atoms (for example, acetyloxy and propionyloxy), a phenyl group, a tolyl group, a hydroxyphenyl group, an amino group, a substituted amino group having 1 to 20, and preferably 1 to 14 carbon atoms (for example, N,N-dimethylamino and N-methyl-N-phenyl-amino), and a cyano group. Among these, an unsubstituted alkyl group (for example, methyl and ethyl) and an alkoxyl group (for example, methoxy and ethoxy) are more preferably used.

Examples of the substituent groups on the nitrogen atom include an unsubstituted alkyl group having 1 to 10, and preferably 2 to 4 carbon atoms (for example, methyl, ethyl, propyl, and butyl), a carboxyalkyl group having 1 to 10, and preferably 2 to 6 carbon atoms (for example, 2-carboxyethyl and carboxymethyl), a sulfoalkyl group having 1 to 10, and preferably 2 to 6 carbon atoms (for example, 2-sulfoethyl, 3-sulfopropyl, 4-sulfobutyl, and 3-sulfobutyl), a methanesulfonylcarbamoylmethyl group, a cyanoalkyl group having 1 to 6, and preferably 1 to 4 carbon atoms (for example, cyanoethyl and cyanopropyl), a halogenated alkyl group having 1 to 10, and preferably 1 to 6 carbon atoms (for example, trifluoromethyl and 2,2,2-trifluoroethyl), a hydroxyalkyl group having 1 to 10, and preferably 1 to 6 carbon atoms (for example, 2-hydroxyethyl and 2-hydroxypropyl), an alkoxycarbonylalkyl group having 3 to 16, and preferably 3 to 8 carbon atoms (for example, methoxycarbonylethyl and ethoxycarbonylmethyl), an alkoxyalkyl group having 2 to 16, and preferably 2 to 8 carbon atoms (for example, methoxyethyl and ethoxyethyl), an acyl group having 3 to 12, and preferably 3 to 8 carbon atoms (for example, acetyl, propionyl, benzoyl, and mesyl), a carbamoyl group having 1 to 10, and preferably 1 to 6 carbon atoms (for example, carbamoyl, N,N-dimethylcarbamoyl, morpholinocarbonyl, and piperidinocarbonyl), a sulfamoyl group having 1 to 10, and preferably 1 to 6 carbon atoms (for example, sulfamoyl, N,N-dimethylsulfamoyl, morpholinosulfonyl, and piperidinosulfonyl), and an aryl group having 6 to 18, and preferably 6 to 10 carbon atoms (for example, phenyl, 4-chlorophenyl, 4-methylphenyl, and α-naphthyl). Among these, an unsubstituted alkyl group (for example, methyl and ethyl), a sulfoalkyl group (for example, 3-sulfopropyl and 4-sulfobutyl) and an acetyl group are more preferably used.

Groups which are particularly preferably used as $R_3$ are a pyrazinyl group and a 5-methylpyrazinyl group.

$L_1$ and L2 each represents a substituted or unsubstituted methine group. Examples of substituent groups for the methine group include unsubstituted and substituted alkyl groups having 1 to 8, and preferably 1 to 4 carbon atoms (for example, methyl, ethyl and 2-carboxyethyl), substituted and unsubstituted aryl groups having 6 to 15, and preferably 6 to 10 carbon atoms (for example, phenyl and o-carboxyphenyl), an alkoxyl group having 1 to 8, and preferably 1 to 4 carbon atoms (for example, methoxy and ethoxy), a halogen atom (for example, chlorine, bromine and fluorine), an amino group, a substituted amino group having 1 to 20, and preferably 1 to 14 carbon atoms (for example, N,N-diphenylamino, N-methyl-N-phenylamino, N-methylpiperadino), a carboxyl group, and an alkylthio group having 1 to 6, and preferably 1 to 3 carbon atoms (for example, methylthio and ethylthio). Further, $L_1$ and $L_2$ can combine with each other or with an auxochrome to form a ring.

n represents 0 or an integer of 1 to 3, and particularly preferably 0, 1, or 2.

As to the substituent groups represented by $R_1$, $R_2$ and $R_3$, the group of atoms represented by Z, and n, preferred combinations thereof are combinations in which n is 0, 1, or 2 and $R_3$ is a pyrazinyl group; further preferred combinations are combinations in which Z forms a benzoxazole nucleus in addition to the above combinations; more preferred combinations are combinations in which $R_1$ is a sulfoalkyl group (for example, 2-sulfoethyl, 3-sulfopropyl, 3-sulfobutyl, and 4-sulfobutyl) and $R_2$ is a hydroxyalkoxyalkyl group (for example, hydroxymethoxymethyl and 2-hydroxyethoxyethyl) or a hydroxyalkyl group (for example, 2-hydroxyethyl and 2-hydroxypropyl) in addition to the above combinations; and particularly preferred combinations are combinations in which $R_3$ is an unsubstituted pyrazinyl group or a 5-methylpyrazinyl group in addition to the above combinations.

Examples of compounds represented by general formula (I) are shown below. However, the compounds should not be construed as being limiting to these examples.

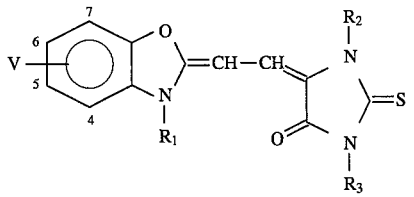

| Compound No | V | $R_1$ | $R_2$ | $R_3$ |
|---|---|---|---|---|
| I-1 | 5-Cl | $(CH_2)_2SO_3K$ | 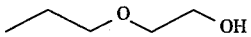 | 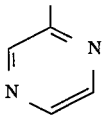 |
| I-2 | 5-Cl | $(CH_2)_3SO_3K$ | 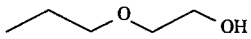 | 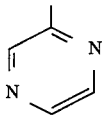 |
| I-3 | 5-Cl | $(CH_2)_4SO_3K$ | 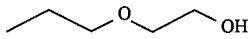 | 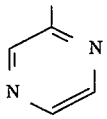 |
| I-4 | 5-F | $(CH_2)_3SO_3Na$ | $C_2H_4OH$ | 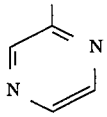 |
| I-5 | H | $(CH_2)_2SO_3K$ | 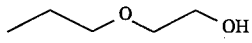 | 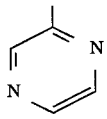 |

-continued
| | | | | |
|---|---|---|---|---|
| I-6 | 5-$CH_3$ | $(CH_2)_2SO_3Na$ | $CH_2CO_2H$ | 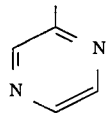 |
| I-7 | 5-$CH_3$ | $(CH_2)_2SO_3Na$ | $(CH_2)_2CO_2H$ | 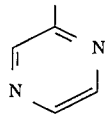 |
| I-8 | 5,6-$Cl_2$ | $(CH_2)_2OH$ | 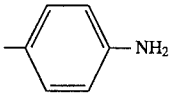 | 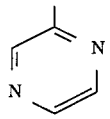 |
| I-9 | 6-$CH_3$ | $(CH_2)_2SO_3Na$ | $C_2H_5$ | 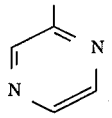 |
| I-10 | 5-Cl | $(CH_2)_3SO_3K$ | 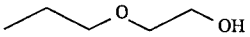 | 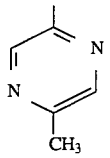 |
| I-11 | 5-Cl | $(CH_2)_2CH(CH_3)SO_3K$ | 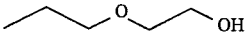 | 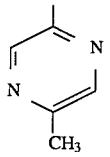 |
| I-12 | 5-$CF_3$ | $(CH_2)_3SO_3K$ | $CH_2CONH(CH_2)_2N(CH_3)_2$ | 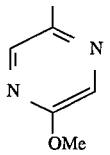 |
| I-13 | 5-Cl | $(CH_2)_4SO_3K$ | 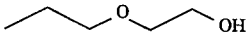 | 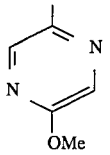 |
| I-14 | 5-$COCH_3$ | $(CH_2)_3SO_3K$ | $(CH_2)_2N(CH_3)_2$ | 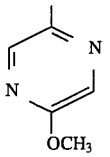 |
| I-15 | 5-Cl | $(CH_2)_2SO_3K$ | 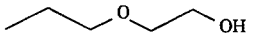 | 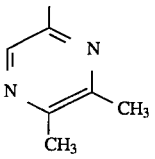 |
| I-16 | 5-$CH_3O$ | $(CH_2)_2SO_3Na$ | 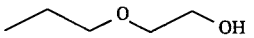 | 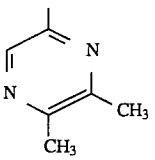 |

-continued
| | | | | |
|---|---|---|---|---|
| I-17 | 5,6-$Cl_2$ | $(CH_2)_2CH(CH_3)SO_3K$ | $(CH_2)_2OH$ | 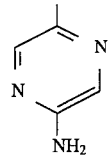 |
| I-18 | 5-Cl | $(CH_2)_3SO_3K$ | $CH_2CO_2H$ | 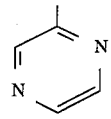 |
| I-19 | 5-Cl | $(CH_2)_2SO_3^-.N^+H(C_2H_5)_3$ | 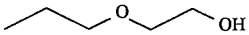 | 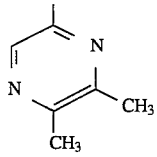 |
| I-20 | 5-F | $(CH_2)_4SO_3K$ | $(CH_2)_4SO_3^-$ | 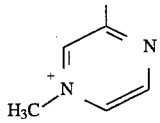 |
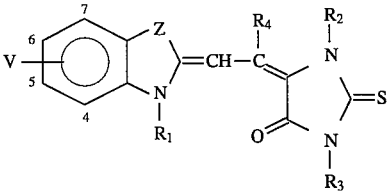
| Compound No | V | $R_1$ | $R_2$ | $R_3$ | $R_4$ | Z |
|---|---|---|---|---|---|---|
| I-21 | H | $(CH_2)_4SO_3K$ | $(CH_2)_2OH$ | 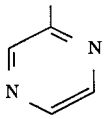 | H | S |
| I-22 | 5-$CH_3$ | $(CH_2)_3SO_3K$ | $CH_2CO_2H$ | 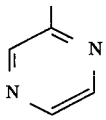 | H | S |
| I-23 | 5-Cl | $(CH_2)_2SO_3K$ | 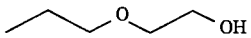 | 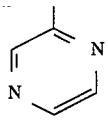 | H | S |
| I-24 | 5-$C_6H_5$ | $CH_2CONHSO_2CH_3$ | 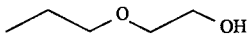 | 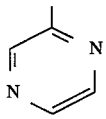 | H | S |
| I-25 | H | $CH_2CONHSO_2CH_3$ | H | 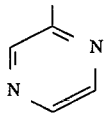 | H | S |
| I-26 | H | $(CH_2)_4SO_3K$ | $(CH_2)_2OH$ | 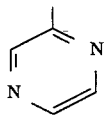 | $CH_3$ | S |

-continued
| | | | | | | |
|---|---|---|---|---|---|---|
| I-27 | 5,6-$Cl_2$ | $CH_2CONHSO_2CH_3$ | $(CH_2)_2OH$ | 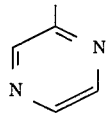 | H | N−$C_2H_5$ |
| I-28 | H | $(CH_2)_4SO_3K$ | 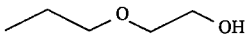 | 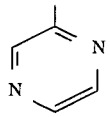 | H | N−$C_2H_5$ |
| I-29 | 5-Cl | $C_2H_5$ | 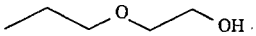 | 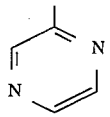 | H | Se |
| I-30 | H | $C_2H_5$ | 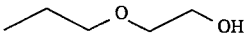 | 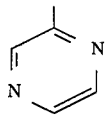 | H | Te |
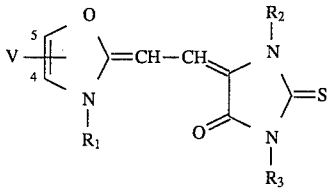
| Compound No | V | $R_1$ | $R_2$ | $R_3$ |
|---|---|---|---|---|
| I-31 | H | $(CH_2)_3SO_3K$ | 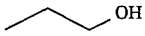 | 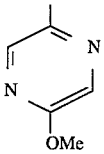 |
| I-32 | 4-$CH_3$ | $(CH_2)_3SO_3K$ | 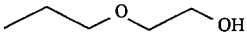 | 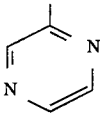 |
| I-33 | 4,5-$(CH_3)_2$ | $CH_2SO_3K$ | 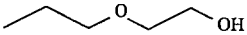 | 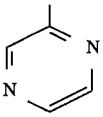 |
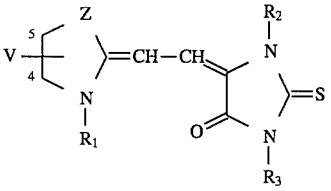
| Compound No | V | $R_1$ | $R_2$ | $R_3$ | Z |
|---|---|---|---|---|---|
| I-34 | H | $(CH_2)_2SO_3K$ | $(CH_2)_2OH$ | 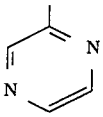 | O |

-continued
| | | | | | |
|---|---|---|---|---|---|
| I-35 | 4-$CH_3$ | $(CH_2)_2SO_3K$ | 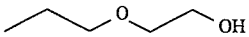 | 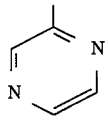 | O |
| I-36 | H | $(CH_2)_2SO_3K$ | 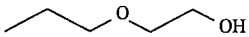 | 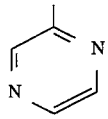 | S |
| I-37 | 4-$CH_3$ | $(CH_2)_2SO_3K$ | $(CH_2)_2OH$ | 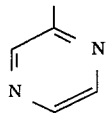 | S |
I-38
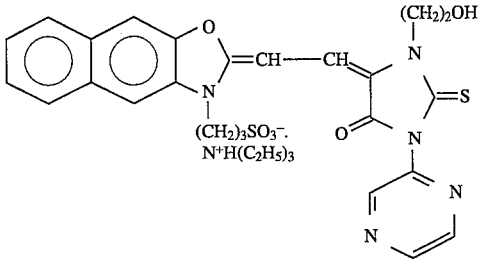
I-39
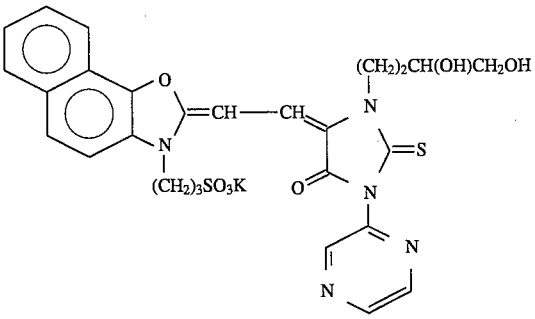
I-40
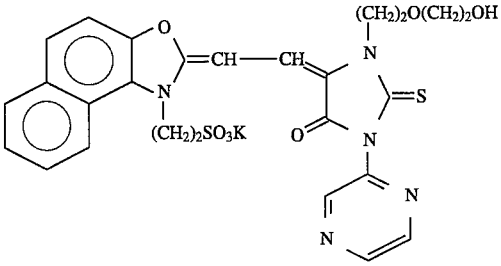
I-41
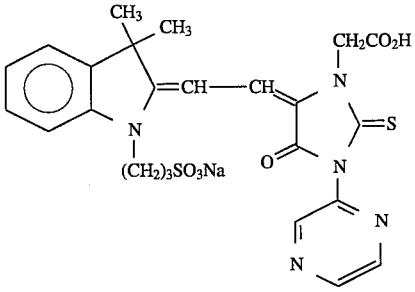

-continued
I-42
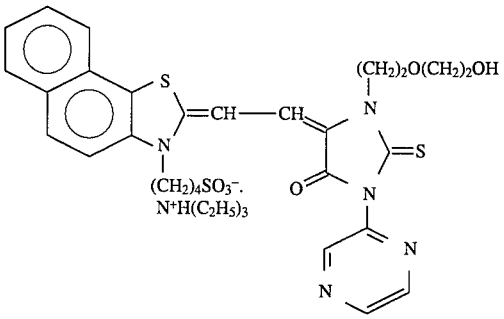
I-43
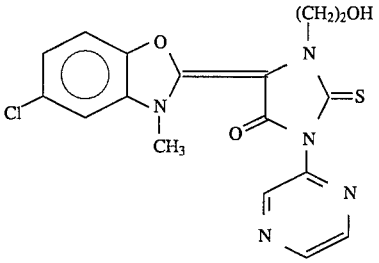
I-44
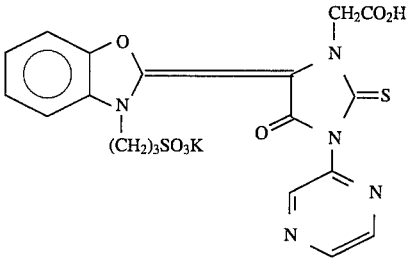
I-44
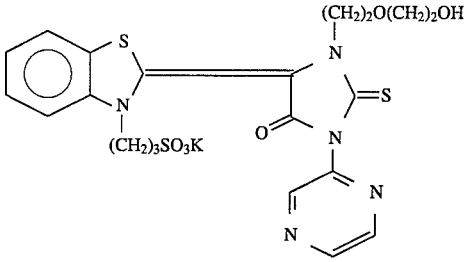
I-45
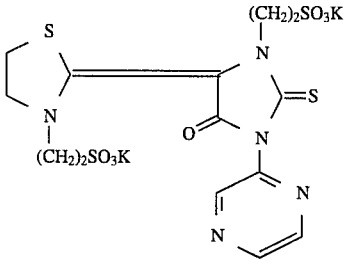

-continued
I-46
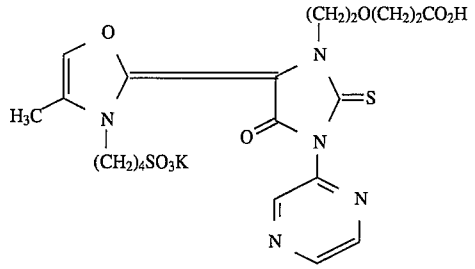
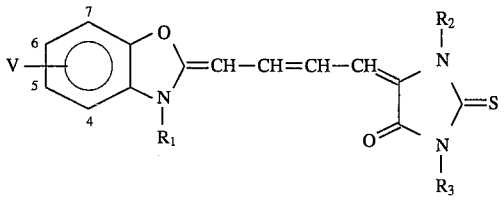
| Compound No | V | $R_1$ | $R_2$ | $R_3$ |
|---|---|---|---|---|
| I-47 | H | $C_2H_5$ | $(CH_2)_2OH$ | 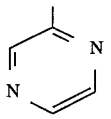 |
| I-48 | H | $(CH_2)_4SO_3K$ | $(CH_2)_2OH$ | 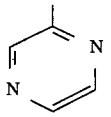 |
| I-49 | 5-Cl | $C_2H_5$ | $(CH_2)_2OH$ | 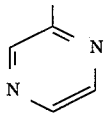 |
| I-50 | 5-Cl | $(CH_2)_4SO_3K$ | $(CH_2)_2OH$ | 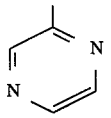 |
I-51
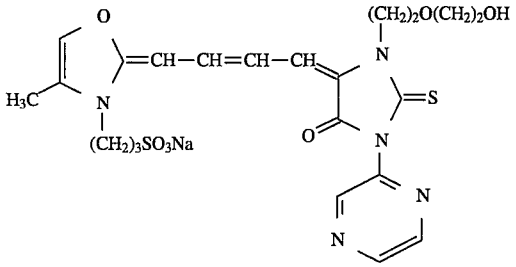
I-52
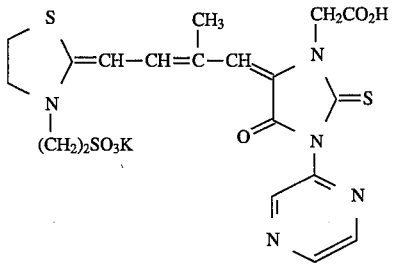

-continued

I-53

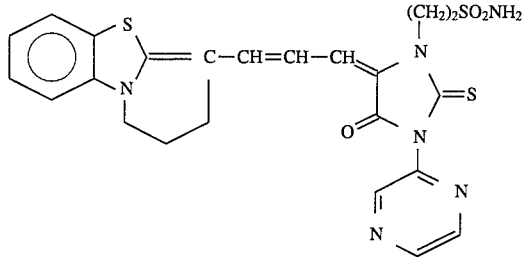

I-54

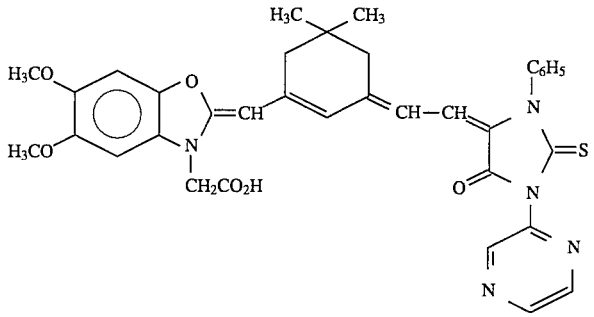

I-55

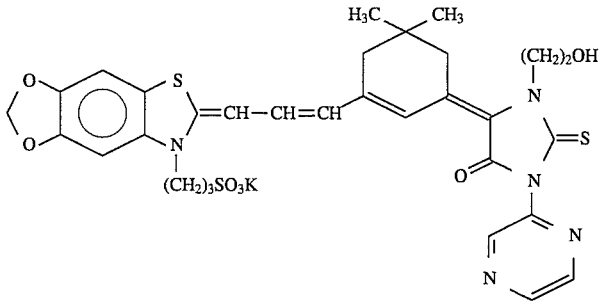

I-56

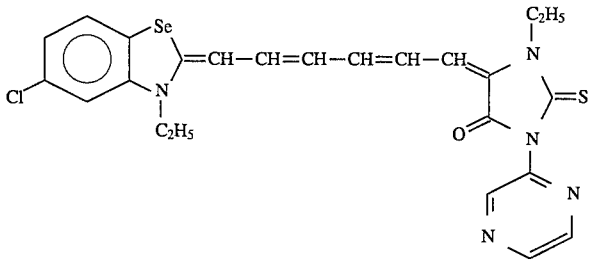

I-57

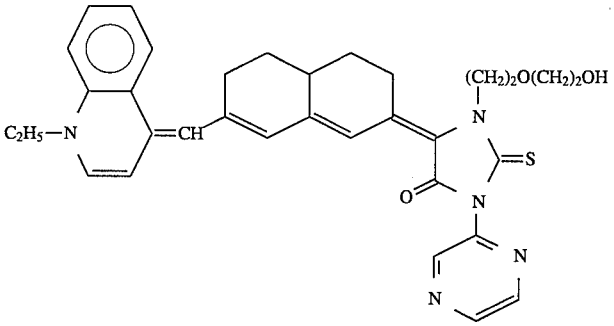

For the preparation of these methine compounds represented by general formula (I) in the present invention, reference can be made to synthesis examples described in the following literature and the literature cited therein:

a) *Dokl. Akad. Nauk SSSR, Vol.* 177, p. 189 (1967).

b) F. M. Harmer, *Heterocyclic Compounds—Cyanine Dyes and Related compound*, John Wiley & Sons, New York, London (1964).

c) D. M. Starmer, *Heterocyclic Compounds—Special Typics in Heterocyclic Chemistry*, pp. 482–515, John Wiley & Sons, New York, London (1977).

d) JP-B-47-4085, JP-B-46-549 and U.S. Pat. Nos. 3,625,698 and 3,567,458.

Further, the compounds represented by general formula (I) can also be obtained from intermediates prepared according to processes described in the following 1), 2) and 3):

1) a process for preparing a salt of dithiocarbamic acid by reacting an amine substituted by a pyrazinyl group represented by $R_3$ in general formula (I) with carbon disulfide and a basic compound. Examples of the basic compound which is preferably used for the reaction include an amine having 1 to 20, and more preferably 3 to 10 carbon atoms (for example, triethylamine, diisopropylethylamine and pyridine), an alkali metal alkoxide having 1 to 4 carbon atoms (for example, sodium methoxide and potassium ethoxide), ammonia, an alkali metal carbonate (for example, potassium carbonate and sodium carbonate), and an alkali metal hydroxide (for example, sodium hydroxide and potassium hydroxide). Among these, triethylamine and pyridine are most preferably used.

2) a process for preparing an alkyl dithiocarbamate by reacting the salt of dithiocarbamic acid thus prepared with an alkyl halide having 1 to 6, and preferably 1 to 4 carbon atoms (for example, methyl iodide and ethyl iodide).

3) a process for preparing a thiohydantoin ring compound in which the respective groups represented by $R_2$ and $R_3$ in general formula (I) are substituted by reacting the alkyl dithiocarbamate thus prepared with an alkyl aminoacetate in which its amino group is substituted by a group represented by $R_2$ in general formula (I). The reaction system may contain a basic compound. Examples of the basic compound used preferably in the system include an amine having 1 to 20, and more preferably 3 to 10 carbon atoms (for example, triethylamine, diisopropylethylamine and pyridine), an alkali metal alkoxide having 1 to 4 carbon atoms (for example, sodium methoxide and potassium ethoxide), ammonia, an alkali metal carbonate (for example, potassium carbonate and sodium carbonate), and an alkali metal hydroxide (for example, sodium hydroxide and potassium hydroxide). Among these, triethylamine is most preferably used.

A compound prepared according to the processes described in 1), 2) and 3) can be used as a starting material for a subsequent process without being purified from a reaction mixture. A scheme for the processes is shown below as an example.

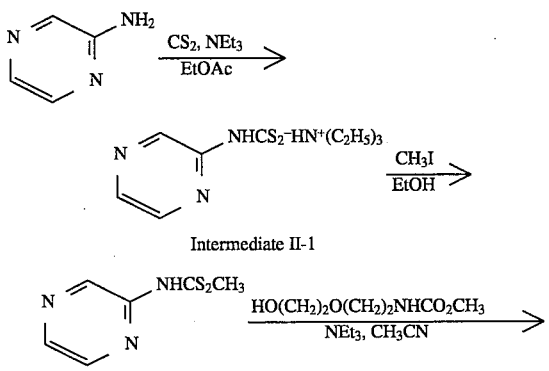

-continued

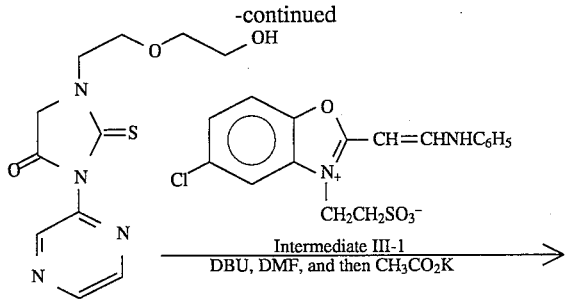

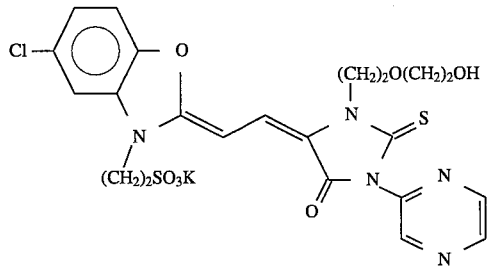

Compound No. I-1

Synthesis of Intermediate II-1:

In a 100-ml flask, 4.9 g (50 mmol) of 3-aminopyrazine, 4.5 g (59 mmol) of carbon disulfide and 50 ml of ethyl acetate were placed, and 6.5 g (64 mmol) of triethylamine was added dropwise with stirring over a 5-min period on a water bath. After the mixture was stirred at 60° C. for 5 hr. 10 ml of hexane was added to the mixture, which was allowed to stand overnight at room temperature to precipitate yellow crystals. The crystals were separated from the solution by filtration, and washed with 5 ml of ethyl acetate to obtain 4.3 g of triethylammonium N-(2-pyrazinyl)-dithiocarbamate (Intermediate II-1). Yield 31%. Mp 113°–116° C. (dec).

$^1$H-NMR (DMSO): δ1.17 (9H, t, J=7 Hz), 3.09 (6H, q, J=7 Hz), 8.16 (2H, brs), 8.35 (2H, brs).

Synthesis of Intermediate II-2:

In a 50-ml flask, 4.3 g (16 mmol) of intermediate II-1 and 25 ml of ethanol were placed, and 2.2 g (16 mmol) of methyl iodide (95%) dissolved in 3 ml of ethanol was added dropwise, while stirring on a water bath. After the mixture was stirred for 2 hr, 100 ml of water was added to the mixture. Precipitated crystals were separated by filtration, and then dried to obtain 2.3 g of methyl N-(2-pyrazinyl)dithiocarbamate. Yield 79%. Mp 120° C. (dec).

$^1$H-NMR (DMSO): δ2.59 (3H, s), 8.45 (2H, m), 9.10 (brs).

Synthesis of Compound No. III-1:

On an oil bath of 120° C. 125 g of 2-amino-4-chlorophenol, 256 g of pyridinium bromoethanesulfonic acid, and 30 ml of tetrahydrofuran were mixed and stirred for 4 hours. Then, 200 ml of acetic anhydride was dropped therein over 10 minutes, and the mixture was further refluxed for 5 hours. After the mixture was cooled until the liquid temperature was reduced to 50° C., 187 g of N,N'-diphenylformamide was added thereto. Reaction was conducted for 45 minutes on the oil bath while maintaining the liquid temperature at 105° C., and then the mixture was cooled on a water bath. When the liquid temperature on the water bath was reduced to 50° C., 1 liter of acetonitrile was further added thereto. The thus produced crystals were washed under heating with 50% water-containing methanol to obtain 141 g of intermediate III-1 (total yield: 43%). IR (KBr): 3440, 1459, 1158, 1498, 1475, 1328 ($cm^{-1}$). Mp: more than 300° C.

Synthesis of Compound No. I-1:

In a 100-ml three-necked flask equipped with a trap containing an aqueous solution of sodium hypochlorite, 2.5 g (13.1 mmol) of methyl N-(2-hydroxyethoxyethyl)-2-aminoacetate, 2.0 g (10.8 mmol) of intermediate II-2 and 30 ml of acetonitrile were placed, and 5 ml of triethylamine was added to the resulting mixture. When the mixture was heated to 100° C. for 2 hr, intermediate II-2 almost disappeared from the mixture. The solvent was removed from the reaction mixture by distillation under reduced pressure. Thus, 4.1 g of a reddish brown oil was obtained, which contained intermediate II-3 as a main component.

In a 100-ml flask, 2.0 g of the oil thus prepared, 1.5 g (4.0 mmol) of intermediate III-1 and 15 ml of DMF were placed to make a suspension at 25° C. To the suspension, 1.2 g (8 mmol) of 1,8-diazabicyclo[5,4,0]-7-undecene dissolved in 10 ml of DMF was added dropwise to the mixture and stirred at 25° C. for 30 min. After the reaction mixture was filtered and the filtrate was diluted with 100 ml of ethanol, 1 g of potassium acetate dissolved in 30 ml of ethanol was added to the diluted filtrate to precipitate orange-shade red crystals. The crystals were separated from the solution by filtration, washed with 30 ml of ethanol, and then recrystallized from a mixed solvent of methanol and acetonitrile to obtain 820 mg of compound No. I-1. $\lambda_{max}$(methanol): 486.4 nm ($\epsilon$=8.26×10$^4$). Mp: more than 300° C.

Other compounds represented by general formula (I) which are used in the present invention can also be readily prepared according to similar processes.

Although the compounds represented by general formula (I) of the present invention may be added to an arbitrary layer in the silver halide photographic material, it is preferred that the compounds are in conditions where they are adsorbed by photosensitive silver halide particles contained in a hydrophilic colloid layer.

To add the compounds represented by general formula (I) of the present invention to the silver halide emulsion of the present invention, they may be directly dispersed into the emulsion, or may be dissolved in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, and N,N-dimethylformamide or in a mixed solvent thereof, and then added to-the emulsion.

There can also be used a method that a dye dissolved in an organic solvent is dispersed into water or into a hydrophilic colloid and then added to the emulsion as described in U.S. Pat. No. 3,469,987; a method that a water-insoluble dye is dispersed into a water-soluble solvent without being dissolved and then added to the emulsion as described in JP-B-46-24185; a method that a dye dissolved in an acid is added to the emulsion or a dye dissolved in water in the presence of an acid or a base is added to the emulsion as described in JP-B-44-23389, JP-B-44-27555 and JP-B-57-22091; a method that a dye is converted to an aqueous solution or to a colloid dispersion in the presence of a surfactant, and then added to the emulsion as described in U.S. Pat. Nos. 3,822,135 and.4,006,026; a method that a dye is directly dispersed into a hydrophilic colloid and then added to the emulsion as described in JP-A-53-102733 and JP-A-58-105141; and a method that a dye is dissolved by use of a compound causing a red shift and then added to the emulsion as described in JP-A-51-74624.

A ultrasonic wave can also be used for dissolving dyes.

The addition of the sensitizing dyes used in the present invention to the silver halide emulsion of the present invention may be carried out at any step of the process for preparing the emulsion, at which the addition has been recognized as useful. For example, the addition may be conducted at a step of forming silver halide particles or/and at a step prior to salt removal, or at a step of salt removal and/or at a step between salt removal and chemical ripening as disclosed in U.S. Pat. Nos. 2,735,766, 3,628,960, 4,183,756, and 4,225,666, JP-A-58-184142, JP-A-60-196749, and so forth; and at a step immediately before chemical ripening or at a step of chemical ripening and at any step between chemical ripening and coating of the emulsion as disclosed in JP-A-58-113920 and so forth. A single dye or a mixture of dyes different in structure may be dividedly added both at a step of forming particles and at a step of chemical ripening or after the chemical ripening, or may be dividedly added before the chemical ripening, during the chemical ripening, and after the chemical ripening. The kinds of a dye used singly or a mixture of dyes which is dividedly added at a plurality of steps may be different at the respective steps.

Although the content of the compounds represented by general formula (I) of the present invention varies depending upon the shape and size of silver halide particles, the content ranges from 0.1 to 4 mmol, and preferably from 0.2 to 2.5 mmol per mol of silver halide. The compounds represented by general formula (I) may be used together with other kinds of sensitizing dyes.

The silver halide emulsion prepared in the present invention can be adopted to any of black-and-white photographic materials and color photographic materials. The black-and-white photographic materials include photosensitive films for printing, X-ray photographic films and films for general photographing; and the color photographic materials include color paper, films for color photographing and color reversal films. However, the emulsion prepared in the present invention is most preferably used for a superhigh-contrast silver halide photographic material for a photomechanical process.

Other additives for the photographic material to which the emulsion of the present invention is applied are not particularly limited. For example, reference can be made to *Research Disclosure*, Vol. 176, Item 17643 (RD17643) and *ibid.*, Vol. 187, Item 18716 (RD18716).

Nucleating agents are preferably used for the photosensitive materials of the present invention.

Hydrazine compounds described in U.S. Pat. No. 4,080,207 and JP-A-2-77057, in addition to *Research Disclosure*, Item 23516 (p. 346, November, 1983) and the literature cited therein, can be used as the nucleating agents. In the present invention, the content of the nucleating agents ranges preferably from 1×10$^{-6}$ to 5×10$^{-2}$ mol, and more preferably from 1×10$^{-5}$ to 2×10$^{-2}$ mol per mol of silver halide.

Redox compounds from which development inhibitors are released by oxidation may also be used in the present invention. Examples thereof include compounds described in JP-A-61-213847 and JP-A-62-260153. The redox compounds can be used preferably in the range of 1×10$^{-6}$ to 5×10$^{-2}$ mol, and more preferably in the range of 1×10$^{-5}$ to 1×10$^{-2}$ mol per mol of silver halide. To use the redox compounds, they are dissolved in a suitably organic water-miscible solvent such as alcohols (for example, methanol, ethanol, propanol, and fluorinated alcohols), ketones (for example, acetone and ethyl methyl ketone), dimethylformamide, dimethylsulfoxide, and methyl cellosolve. Further, according a method known well as emulsification dispersion, the redox compounds are dissolved in an oil such as dibutyl phthalate, tricresyl phosphate, glyceryl triacetate, and diethyl phthalate with the help of a co-solvent such as ethyl acetate and cyclohexanone followed by preparing mechanically an emulsified dispersion. Furthermore, according to a method known as solid dispersion, powdered redox compounds may be dispersed into water by use of a ball mill or a colloid mill, or through a ultrasonic wave.

Although the composition of halides in the silver halide emulsion used in the present invention is not particularly limited, silver chlorobromide or silver iodochlorobromide containing 50 mol % or more of silver chloride is preferably used. The content of silver iodide is preferably 3 mol % or less, and more preferably 0.5 mol % or less.

The silver halide emulsion of the present invention is preferably a monodispersion emulsion in which the coefficient of variation is preferably 20% or less, and more preferably 15% or less. The coefficient of variation (%) is obtained by dividing the standard deviation of particle size by an average value of particle size followed by multiplying the quotient by 100. The average particle size of particles contained in the monodispersion silver halide emulsion is preferably 0.5 μm or less, and more preferably from 0.1 to 0.4 μm.

Various techniques known in the field of silver halide photographic materials are used for preparing the monodispersion silver halide emulsion. The techniques are described in, for example, P. Glafkids, *Chimie et Physique Photographique*, Paul Montel, 1967; G. F. Duffin, *Photographic Emulsion Chemistry*, The Focal Press, 1966; and V. L. Zelikman et al., *Making and Coating Photographic Emulsion*, The Focal Press, 1964.

Techniques for reacting water-soluble silver salts (for example, silver nitrate) with water-soluble halide salts, which can be used in the present invention, include one-side mixing techniques, simultaneous mixing techniques and combined techniques thereof. A type of the simultaneous mixing techniques is a control double jet technique in which the pAg of the liquid phase where silver halide is formed is kept constant. So-called silver halide solvents such as ammonia, thioethers and tetra-substituted thioureas are preferably used to form particles. The silver halide solvents which are more preferably used are tetra-substituted thioureas, which are described in JP-A-53-82408 and JP-A-55-77737. Examples of the preferred thioureas are tetramethylthiourea and 1,3-dimethyl-2-imidazolidinethione.

A method for forming particles according to the control double jet technique and by use of a silver halide solvent is easy to prepare a silver halide emulsion which has a regular crystal form and a narrow distribution in particle size, and is an effective means to prepare the emulsion used in the present invention.

The monodispersion emulsion preferably contains a regular crystal form such as a cube, an octahedron and a tetradecahedron. Among these, a cube is particularly preferred. The inside and surface of the silver halide particle may consist of a uniform phase, respectively, or may consist of phases different from each other.

The monodispersion emulsion used in the present invention is preferably subjected to chemical sensitization. There can be used known methods of the chemical sensitization such as sulfur sensitization, reduction sensitization and gold sensitization. They may be carried out, singly or in combination of these techniques. Preferred chemical sensitization is gold sulfur sensitization.

Sulfur sensitizers used in the present invention include various sulfur compounds such as thiosulfates, thioureas, thiazoles, and rhodanines, in addition to sulfur compounds contained in gelatin. Examples thereof are described in U.S. Pat. Nos. 1,574,944, 2,278,947, 2,410,689, 2,728,668, 3,501,313, and 3,656,955. Preferred sulfur compounds are thiosulfates and thiourea compounds. During the chemical ripening, pAg is preferably kept at 8.3 or less, and more preferably in the range of 7.3 to 8.0. A method for using polyvinyl pyrrolidone together with a thiosulfate, which is described in Moisar, *Klein Gelatine. Proc. Syme.*, 2nd, 301–309 (1970), also gives a satisfactory result.

Gold compounds, mainly gold complex salts, are used for the gold sensitization which is typical noble metal sensitization. Noble metals other than gold, such as platinum, palladium and iridium, may also be used in a form of complex salts. Examples thereof are described in U.S. Pat. No. 2,448,060 and British Patent 618,061.

Gelatin is advantageously used as a binder or as a protective colloid for the photographic emulsion. However, hydrophilic colloid other than gelatin can also be used. Examples of the hydrophilic colloid include gelatin derivatives, graft polymers of gelatin and other polymers, proteins such as albumin and casein, cellulose derivatives such as hydroxyethyl cellulose, carboxymethyl cellulose and cellulose sulfates, saccharide derivatives such as alginic acid and starch derivatives, and various synthesized hydrophilic homopolymers and copolymers consisting of polyvinyl alcohol, partial acetals of polyvinyl alcohol, poly-N-vinylpyrrolidone, polyacrylic acid, polymethacrylic acid, polyacrylamide, polyvinylimidazole, polyvinylpyrazole, or others.

Acid-treated gelatin, hydrolyzed products of gelatin and degradation products of gelatin by an enzymatic reaction can also be used in place of lime-treated gelatin.

To obtain photographic characteristics such as superhigh-contrast gradation and high sensitivity, the silver halide photo-graphic material of the present invention is not necessary to process with customary infectious developers or with highly alkaline developers adjusted to pH about 13 as described in U.S. Pat. No. 2,419,975, and can be processed with more stable developers.

That is, the silver halide photographic material of the present invention can be processed with a developer of pH 9.6 to 12.0 which contains 0.15 to 2.5 mol/liter of sulfite ion as a preservative to give a sufficiently superhigh-contrast negative image.

Developing agents for the developer used in the present invention are not particularly limited. However, to ensure good halftone quality, dihydroxybenzenes are preferably used, and combinations of dihydroxybenzenes with 1-phenyl-3-pyrazolidones or combinations of dihydroxybenzenes with p-aminophenols can also be used.

Examples of dihydroxybenzene type developing agents include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Among these, hydroquinone is most preferably used.

Examples of 1-phenyl-3-pyrazolidone type developing agents include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of p-aminophenol type developing agents include N-methyl-p-aminophenol, p-aminophenol, N-(β-hydroxyethyl)-p-aminophenol, N-(4-hydroxyphenyl)glycine, 2-methyl-p-amino-phenol, and p-benzylaminophenol. Among these, N-methyl-p-aminophenol is preferably used.

The content of the developing agents is preferably from 0.05 to 0.8 mol/liter in general. When the combinations of dihydroxybenzenes with 1-phenyl-3-pyrazolidones or p-amino-phenols are used, the content of the former is preferably from 0.05 to 0.5 mol/liter and the content of the latter is preferably from 0.06 mol/liter or less.

Sulfites which are used as preservatives for the present invention are sodium sulfite, potassium sulfite, lithium sulfite, ammonium sulfite, sodium bisulfite, potassium metabisulfite, formaldehyde sodium bisulfite, and so forth. The concentration of the sulfites is preferably from 0.15 to 2.5 mol/liter, and particularly preferably from 0.3 to 2.5 mol/liter.

Alkali agents which are used for adjusting pH include pH regulators and buffers such as sodium hydroxide, potassium hydroxide, sodium carbonate, potassium carbonate, sodium tertiary phosphate, and potassium tertiary phosphate. The developer is adjusted to pH 9.6 to 12.0.

Additives other than the above-mentioned components may include compounds such as boric acid and borax; development inhibitors such as sodium bromide, potassium bromide and potassium iodide; organic solvents such as ethylene glycol, diethylene glycol, triethylene glycol, dimethylformamide, methyl cellosolve, hexylene glycol, ethanol, and methanol; antifoggants or black pepper inhibitors such as 1-phenyl-5-mercaptotetrazole, indazole type compounds like 5-nitro-indazole, and benzotriazole type compounds like 5-methyl-benzotriazole, and further may include, as needed, toning agents, surfactants, defoaming agents, hard water softeners, hardeners, and amino compounds described in JP-A-56-106244.

The developers used for the present invention may further contain compounds described in JP-A-56-24347 as silver stain inhibitors, compounds described in JP-A-61-267759 as dissolving assistants which are added to the developer, and compounds described in JP-A-60-93433 or in JP-A-62-186259 as pH buffers.

Fixers having a general composition can be used in the present invention. In addition to thiosulfates and thiocyanates, organic sulfur compounds which are known to be effective in fixing can be used as fixing agents. The fixers may contain a water-soluble aluminum compound (for example, aluminum sulfate and alum) as a hardener. The content of the water-soluble aluminum compound ranges usually 10 to 80 mmol/liter. Further, the fixers may contain iron (III) compounds in a form of ethylenediaminetetraaceto complexes as oxidizing agents. The temperature of development processing is usually adjusted to 18° to 50° C. and preferably to 25° to 43° C.

Use of various additives which can be used in the photographic material of the present invention is not particularly limited. For examples, additives described in the following portions can be preferably used.

| Item | Corresponding Portion |
|---|---|
| 1. Nucleating Accelerators | JP-A-2-103536, page 9, upper right column, line 13 to page 16, upper left column, line 10, general formulas (II-m) to (II-p) and compound examples II-1 to II-22; compounds described in JP-A-1-179939 |
| 2. Surfactants | JP-A-2-12236, page 9, upper right column, line 7 to lower right column, line 7; and JP-A-2-18542, page 2, lower left column, line 13 to page 4, lower right column, line 18 |
| 3. Antifoggants | JP-A-2-103536, page 17, lower right column, line 19 to page 18, upper right column, line 4 and lower right column, line 1 to line 5; and thiosulfinic acid compounds described in JP-A-1-237538 |
| 4. Polymer Latexes | JP-A-2-103536, page 18, lower left column, line 12 to line 20 |
| 5. Acid Group-Containing Compounds | JP-A-2-103536, page 18, lower right column, line 6 to page 19, upper left column, line 1 |
| 6. Matting Agents Lubricants and Plasticizers | JP-A-2-103536, page 19, upper left column, line 15 to page 19, upper right column, line 15 |
| 7. Hardeners | JP-A-2-103536, page 18, upper right column, line 5 to line 17 |
| 8. Dyes | JP-A-2-103536, page 17, lower right column, line 1 to line 18; and solid dyes described in JP-A-2-294638 and JP-A-5-11382 |
| 9. Binders | JP-A-2-18542, page 3, lower right column, line 1 to line 20 |
| 10. Black Pepper Inhibitors | compounds described in U.S. Pat. 4,956,257 and JP-A-1-118832 |
| 11. Monomethine Compounds | compounds represented by general formula (II) of JP-A-2-287532 (particularly, compound examples II-1 to II-26) |
| 12. Dihydroxy-benzenes | JP-A-3-39948, page 11, upper left column to page 12, lower left column; and compounds described in European Patent 452,772A |

The present invention is illustrated below by means of examples. However, the examples should not be construed as limiting the present invention.

EXAMPLE 1

Emulsion A:

To conduct nucleation, a 0.13M aqueous solution of silver nitrate and an aqueous solution of halide salts which contained $(NH_4)_2Rh(H_2O)Cl_5$ in an amount of $1\times10^{-7}$ mol, $K_2IrCl_6$ in an amount of $2\times10^{-7}$ mol per mol of silver, 0.04M of potassium bromide, and 0.09M of sodium chloride were added to an aqueous solution of gelatin containing sodium chloride and 1,3-dimethyl-2-imidazolidinethione with stirring at 38° C. over a 12-minute period according to a double jet method, thus to prepare silver chlorobromide particles which had an average particle size of 0.15 μm and contained 70 mol % of silver chloride. Subsequently, a 0.87M aqueous solution of silver nitrate and an aqueous solution of halide salts which contained 0.26M of potassium bromide and 0.65M of sodium chloride were similarly added over a 20-minute period according to the double jet method.

An $1\times10^{-3}$M solution of potassium iodide was thereafter added to the emulsion to conduct conversion. The emulsion was washed with water as usual according to a flocculation method, and after 40 g of gelatin was added thereto, the resulting emulsion was adjusted to pH 6.5 and to pAg 7.5. Sodium benzenethiosulfonate in an amount of 8 mg, sodium thiosulfate in an amount of 5 mg and chloroauric acid in an amount of 8 mg per mol of silver were further added to the emulsion, which was then heated at 60° C. for 60 minutes to conduct chemical ripening, and 150 mg of 6-methyl-4-hydroxy-1,3,3a,7-tetrazaindene was added thereto as a stabilizer. Cubic particles of silver chlorobromide thus obtained had an average particle size of 0.27 μm and contained 70 mol % of silver chloride (the coefficient of variation: 10%).

Emulsion B:

To conduct nucleation, A 0.13M aqueous solution of silver nitrate and an aqueous solution of halide salts which contained $K_2Ru(NO)Cl_5$ in an amount of $1\times10^{-7}$ mol, $K_3IrCl_6$ in an amount of $2\times10^{-7}$ mol per mol of silver, 0.052M of potassium bromide, and 0.078M of sodium chloride were added to an aqueous solution of gelatin containing sodium chloride and 1,3-dimethyl-2-imidazolidinethione with stirring at 45° C. over a 12-minute period according to the double jet method, thus to prepare silver chlorobromide particles which had an average particle size of 0.15 μm and contained 60 mol % of silver chloride. Subsequently, a 0.87M aqueous solution of silver nitrate and an aqueous solution of halide salts which contained 0.34M of potassium bromide and 0.52M of sodium chloride were added over a 20-minute period according to the double jet method.

An $1\times10^{-3}$M solution of potassium iodide was thereafter added to the emulsion to conduct conversion. The emulsion was washed with water as usual according to the flocculation method, and after 40 g of gelatin was added thereto, the resulting emulsion was adjusted to pH 6.5 and to pAg 7.5. Sodium benzenethiosulfonate in an amount of 8 mg, sodium thiosulfate in an amount of 5 mg and chloroauric acid in an amount of 8 mg per mol of silver were further added to the emulsion, which was then heated at 60° C. for 60 minutes to conduct the chemical sensitization, and 150 mg of 4-hydroxy-6-methyl-1,3,3a,7-tetrazaindene was added thereto as a stabilizer. Cubic particles of silver chlorobromide thus obtained had an average particle size of 0.27 μm and contained 60 mol % of silver chloride (the coefficient of variation: 10%).

Emulsion C:

To conduct nucleation, a 0.13M aqueous solution of silver nitrate and an aqueous solution of halide salts which contained $K_2Ru(NO)Cl_6$ in an amount of $1\times10^{-7}$ mol, $K_3IrCl_6$ in an amount of $2\times10^{-7}$ mol per mol of silver, 0.078M of potassium bromide, and 0.052M of sodium chloride were added to an aqueous solution of gelatin containing sodium chloride with stirring at 45° C. over a 12-minute period according to the double jet method to prepare silver chlorobromide particles which had an average particle size of 0.15 μm and contained 70 mol % of silver chloride. Subsequently, a 0.87M aqueous solution of silver nitrate and an aqueous solution of halide salts which contained 0.522M of potassium bromide and 0.348M of sodium chloride were similarly added to the emulsion over a 20-minute period according to the double jet method.

An $1\times10^{-3}$M solution of potassium iodide was thereafter added to the emulsion to conduct conversion. The emulsion was washed with water as usual according to the flocculation method, and adjusted to pH 6.5 and to pAg 7.5 after 40 g of gelatin was added. Sodium benzenethiosulfonate in an amount of 8 mg, sodium thiosulfate in an amount of 5 mg and chloroauric acid in an amount of 8 mg per mol of silver were further added to the emulsion, which was then heated at 60° C. for 60 minutes to conduct the chemical ripening, and 150 mg of 4-hydroxy-6-methyl-1,3,3a,7-tetrazaindene was added thereto as a stabilizer. Cubic particles of silver chlorobromide thus obtain had an average particle size of 0.27 μm and contained 40 mol % of silver chloride (the coefficient of variation: 11%).

Emulsion D:

An 1M aqueous solution of silver nitrate and an aqueous solution of halide salts which contained $(NH_4)_2Rh(H_2O)Cl_5$ in an amount of $1.2\times10^{-7}$ mol per mol of silver, potassium iodide and potassium bromide were simultaneously added to an aqueous solution of gelatin kept at 50° C. in the presence of ammonia over a 60-minute period, while keeping pAg 7.8. Thus, a cubic monodispersion emulsion was obtained, which had an average particle size of 0.25 μm and an average content of silver iodide of 1 mol %. The emulsion was subjected to remove salts according to the flocculation method, and adjusted to pH 6.0 and to pAg 8.5 after 40 g of gelatin was added. After 5 mg of sodium thiosulfate and 6 mg of chloroauric acid was added, the emulsion was heated to 60° C. for 60 min to conduct the chemical ripening, and 150 mg of 4-hydroxy-6-methyl-1,3,3a,7-tetrazaindene was added as a stabilizer (the coefficient of variation: 9%).

Emulsion E:

An 1.0M aqueous solution of silver nitrate and an aqueous solution of halide salts which contained $(NH_4)_2Rh(H_2O)Cl_5$ in an amount of $3\times10^{-7}$ mol per mol of silver, 0.3M of potassium bromide and 0.74M of sodium chloride were added to an aqueous solution of gelatin containing sodium chloride and 1,3-dimethyl-2-imidazolinethione with stirring at 45° C. over a 30-minute period according to the double jet method to obtain silver chlorobromide particles which had an average particle size of 0.28 μm and contained 70 mol % of silver chloride. The emulsion was washed with water as usual according to the flocculation method, and adjusted to pH 6.5 and to pAg 7.5, after 40 g of gelatin was added. Sodium thiosulfate in an amount of 5 mg and chloroauric acid in an amount of 8 mg per mol of silver were further added to the emulsion, which was heated to 60° C. for 60 min to conduct the chemical ripening, and 150 mg of 4-hydroxy-6-methyl-1,3,3a,7-tetrazaindene was then added to the emulsion as a stabilizer. Thus, cubic particles of silver chlorobromide thus obtained had an average particle size of 0.28 μm and contained 70 mol % of silver chloride (the coefficient of variation: 10%).

Preparation of Coated Samples

Coated samples had a layer structure constituted of a protective layer, an emulsion layer 1, an interlayer, an emulsion layer 2, an antihalation layer, a support, a backing layer, and a backing protective layer in the order from top.

| Protective Layer: (Gelatin 0.25 g/m²) | |
|---|---|
| $SiO_2$ Matting Agent (Particle Size: 3.6 μm, Amorphous Silica) | 60 mg/m² |
| Snowtex C | 60 mg/m² |
| Liquid Paraffin (Gelatin Dispersion) | 30 mg/m² |
| Sodium Dodecylbenzenesulfonate | 19 mg/m² |
| N-Perfluorooctanesulfonyl-N-propylglycine Potassium Salt | 1.4 mg/m² |
| Emulsion Layer 1: (Gelatin 0.22 g/m²) | |
| Emulsion E | Ag: 0.32 g/m² |
| Inhibitor-Releasing Compound A Having the Following Formula | 132 mg/m² |
| Compound of the Present Invention | see Table 1 |
| Dye A Having the Following Formula | 10 mg/m² |
| Ethyl Acrylate Latex (Particle Size: 0.1 μm) | 260 mg/m² |
| Inhibitor-Releasing Compound A | |

-continued

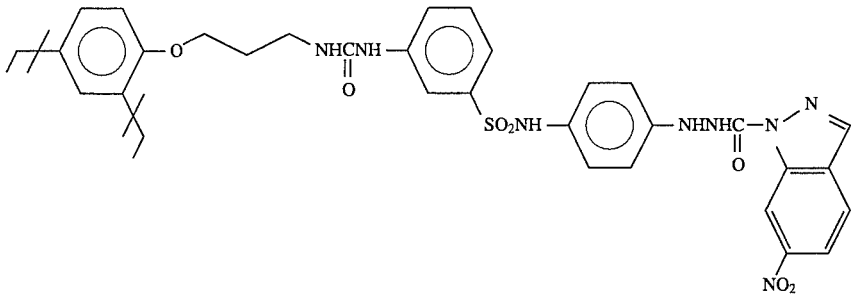

Dye A

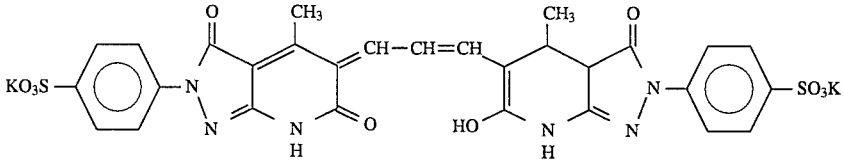

Interlayer: (Gelatin 1.20 g/m$^2$)

| | |
|---|---|
| Hydroquinone | 86 mg/m$^2$ |
| Ethylthiosulfonic Acid | 4.3 mg/m$^2$ |
| Trimethylolpropane | 50 mg/m$^2$ |
| Dye B Having the Following Formula | 67 mg/m$^2$ |
| Ethyl Acrylate Latex (Particle Size: 0.1 μm) | 380 mg/m$^2$ |

Dye B

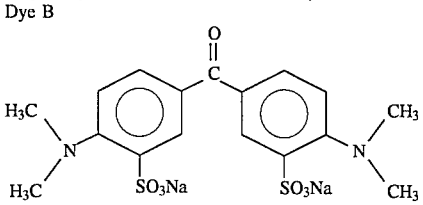

Emulsion Layer 2: (Gelatin 1.61 g/m$^2$)

| | |
|---|---|
| Emulsions A to E (see Table 1) | Ag: 3.60 g/m$^2$ |
| Compound of the Present Invention | see Table 1 |
| Hydrazine Derivative A Having the Following Formula | 35 mg/m$^2$ |
| Hydrazine Derivative B Having the Following Formula | 25 mg/m$^2$ |
| N-Oleyl-N-methyltaurine Sodium Salt | 29 mg/m$^2$ |
| Triethylammonium 3-[2-[5-phenyl-3-(4-sulfobutyl)benzoxazolin-2-ylidenemethyl]-3-naphtho[1,2-d]oxazolio]propanesulfonate | 2 mg/m$^2$ |
| Sodium 3-(5-Mercaptotetrazole)benzenesulfonate | 1.8 mg/m$^2$ |
| Compound A Having the Following Formula | 2.5 mg/m$^2$ |
| Compound B Having the Following Formula | 7.9 mg/m$^2$ |
| Compound C Having the Following Formula | 12.7 mg/m$^2$ |
| Compound D Having the Following Formula | 2.2 mg/m$^2$ |
| Ethyl Acrylate Latex (Particle Size: 0.1 μm) | 600 mg/m$^2$ |
| 1,2-Bis(vinylsulfonylacetamido)ethane | 81 mg/m$^2$ |

Hydrazine Derivative A

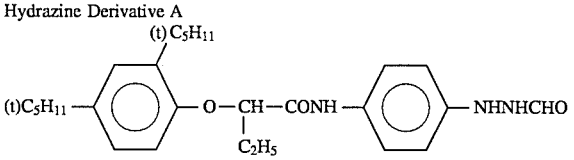

Hydrazine Derivative B

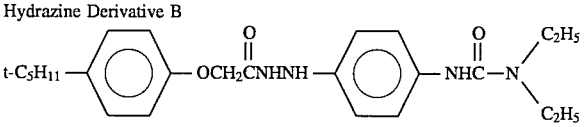

-continued

Compound A

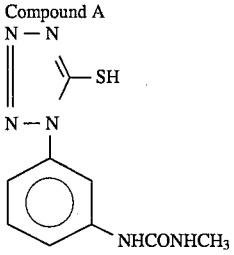

Compound B

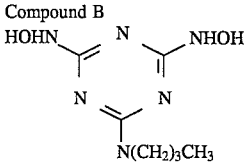

Compound C

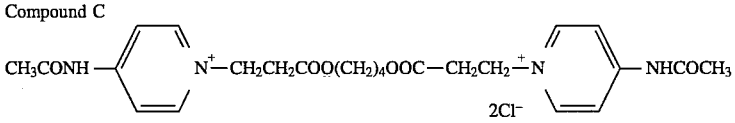

Compound D

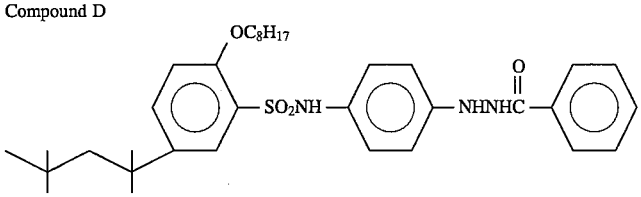

Antihalation Layer: (Gelatin 0.15 g/m$^2$)

| | |
|---|---|
| Ethyl Acrylate Latex (Particle Size: 0.1 μm) | 150 mg/m$^2$ |
| Bis(vinylsulfonyl)methane | 41 mg/m$^2$ |

Backing Layer: (Gelatin 3.16 g/m$^2$)

| | |
|---|---|
| Compound E having the Following Formula | 38.9 mg/m$^2$ |
| Dye C Having the Following Formula | 18 4 mg/m$^2$ |
| Dye D Having the Following Formula | 13.9 mg/m$^2$ |
| Dye E Having the Following Formula | 25.3 mg/m$^2$ |
| Dye F Having the Following Formula | 53.1 mg/m$^2$ |
| Sodium Dodecybenzenesulfonate | 38.9 mg/m$^2$ |
| 1,3-Bis(vinylsulfonyl)-2-propanol | 146 mg/m$^2$ |

Compound E

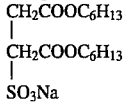

Dye C

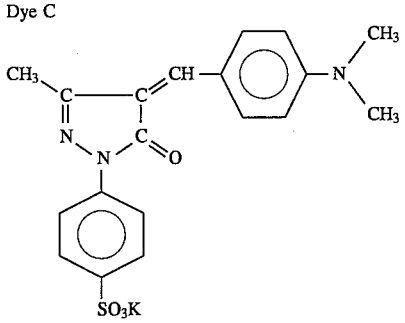

-continued

Dye D

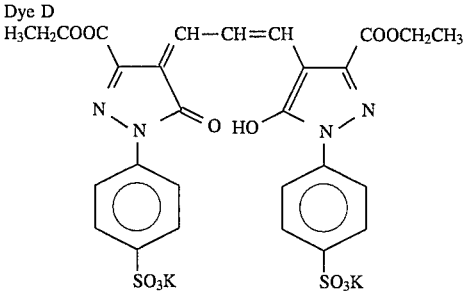

Dye E

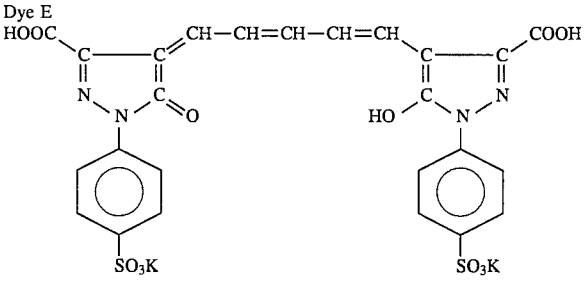

Dye F

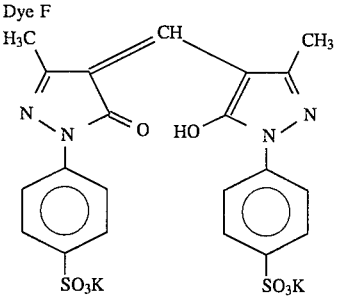

Backing Protective Layer: (Gelatin 1.32 g/m$^2$)

| | |
|---|---|
| Sodium Dodecylbenzenesulfonate | 13.8 mg/m$^2$ |
| Finely Powdered Polymethyl Methacrylate (Particle Size: 2.8 μm) | 15 mg/m$^2$ |
| Sodium Acetate | 57.7 mg/m$^2$ |
| Compound F Having the Following Formula | 16 mg/m$^2$ |
| 1,3-Bis(vinylsulfonyl)-2-propanol | 60.8 mg/m$^2$ |

Compound F $CH_2COOC_6H_{13}$
|
$CH_2COOC_6H_{13}$
|
$SO_3Na$

[Method of Evaluation]

(Formula of Developer)

| | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzoimidazole-5-sulfonic Acid | 0.3 g |
| Sodium 3-(5-Mercaptotetrazole)benzenesulfonate | 0.2 g |
| N-n-Butyldiethanolamine | 15.0 g |
| Sodium p-Toluenesulfonate | 8.0 g |
| Volume: adjusted to 1 liter with water | |
| pH: adjusted to 11.6 with potassium hydroxide | |

(Photographic Characteristics)

Each series of the coated samples thus prepared was divided into three groups. The first group was stored at a temperature of −30° C. for 3 days, the second group at 50° C.−65% RH for 3 days, and the other group at room temperature under a partial pressure of oxygen of 5 atm for 3 days. These samples were exposed to light for sensitometry by use of Sensitometer FWH manufactured by Fuji Photo Film Co., Ltd. and processed with the above-mentioned developer at 34° C. for 30 sec by use of Automatic Processor FG-660F manufactured by Fuji Photo Film Co., Ltd. Fixer GR-F1 manufactured by Fuji Photo Film Co., Ltd. was used as a fixer.

As to the samples thus processed, the fog density and sensitivity were determined by use of a densitometer manufactured by Fuji Photo Film Co., Ltd. The sensitivity was defined as a reciprocal of the exposure quantity giving a density of 1.5 in cases where the samples were processed at 34° C. for 30 sec, and shown by a relative value based on the sensitivity of a reference sample which was made 100. The contrast of the samples represented by γ was determined by the following formula:

γ=(3.0–0.3)/[log(exposure quantity giving a density of 3.0)–log(exposure quantity giving a density of 0.3)]

(Evaluation of Color Residue after Processing)

The samples were processed under the same conditions as those described in the above-mentioned item "photographic characteristics", with the proviso that the samples were not exposed to light at all. The result of evaluation was divided into five grades. Grade 1 exhibits to leave hardly color on the unexposed samples after being processed, and grade 5 to leave most color. Grades 1 and 2 show to be practically usable about the color residue; although grade [3] exhibits to leave some color on the unexposed samples, it shows to be critically recognized as usable; and grades 4 and 5 show to be unusable.

The result of the evaluation is shown in Table 1.

Comparative Compound C-1

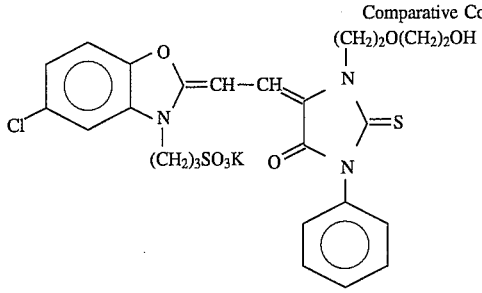

Comparative Compound C-2

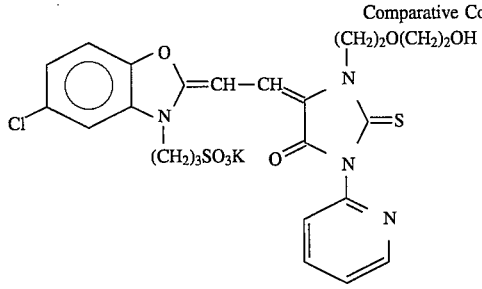

Comparative Compound C-3

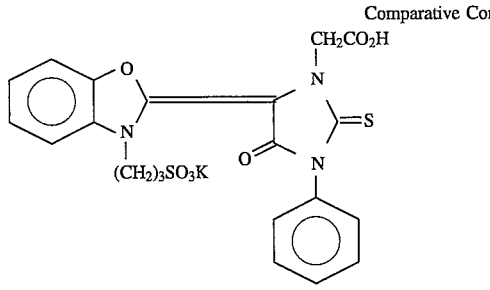

TABLE 1

| Sample No. | Emulsion in Emulsion 2 | Polymethine Dye Dye | Polymethine Dye Content ($\times 10^{-4}$ MAg) | Storage at −30° C. Sensitivity | Storage at −30° C. Fog | Storage at −30° C. γ | Storage at 50° C.-65% RH Sensitivity | Storage at 50° C.-65% RH Fog |
|---|---|---|---|---|---|---|---|---|
| 1 | A | C-1 | 3.0 | 100*1 | 0.03 | 12 | 84 | 0.04 |
| 2 | A | C-2 | 3.0 | 105 | 0.03 | 11 | 94 | 0.04 |
| 3 | A | I-1 | 3.0 | 107 | 0.02 | 11 | 110 | 0.03 |
| 4 | A | I-5 | 3.0 | 120 | 0.03 | 11 | 123 | 0.03 |
| 5 | A | I-10 | 3.0 | 115 | 0.02 | 12 | 117 | 0.02 |
| 6 | A | I-16 | 3.0 | 105 | 0.02 | 11 | 100 | 0.02 |
| 7 | B | C-1 | 3.0 | 100*1 | 0.02 | 10 | 89 | 0.02 |
| 8 | B | I-1 | 3.0 | 110 | 0.02 | 11 | 107 | 0.02 |
| 9 | B | I-31 | 3.0 | 126 | 0.02 | 12 | 123 | 0.02 |
| 10 | B | I-36 | 3.0 | 141 | 0.03 | 13 | 141 | 0.03 |
| 11 | C | C-1 | 3.0 | 100*1 | 0.03 | 11 | 91 | 0.03 |
| 12 | C | I-12 | 3.0 | 112 | 0.02 | 11 | 110 | 0.02 |
| 13 | C | I-40 | 3.0 | 120 | 0.02 | 11 | 115 | 0.02 |
| 14 | D | C-3 | 3.0 | 100*1 | 0.02 | 10 | 90 | 0.02 |
| 15 | D | I-44 | 3.0 | 115 | 0.03 | 12 | 117 | 0.03 |
| 16 | E | C-1 | 3.0 | 100*1 | 0.03 | 11 | 98 | 0.03 |
| 17 | E | I-2 | 3.0 | 120 | 0.02 | 12 | 126 | 0.02 |

| Sample No. | Storage under $O_2$ Pressure of 5 atm Sensitivity | Storage under $O_2$ Pressure of 5 atm Fog | Color Residue | Note |
|---|---|---|---|---|
| 1 | 88 | 0.05 | 4 | Comparative Example |
| 2 | 92 | 0.04 | 2 | Comparative Example |
| 3 | 110 | 0.03 | 1 | Present Invention |
| 4 | 120 | 0.04 | 1 | Present Invention |
| 5 | 115 | 0.02 | 2 | Present Invention |
| 6 | 105 | 0.02 | 2 | Present Invention |

TABLE 1-continued

| Sample No. | Emulsion in Emulsion 2 | Polymethine Dye Dye | Content ($\times 10^{-4}$ MAg) | Storage at −30° C. Sensitivity | Fog | γ | Storage at 50° C.-65% RH Sensitivity | Fog |
|---|---|---|---|---|---|---|---|---|
| | | 7 | 92 | 0.03 | | 4 | Comparative Example | |
| | | 8 | 105 | 0.02 | | 1 | Present Invention | |
| | | 9 | 120 | 0.03 | | 2 | Present Invention | |
| | | 10 | 132 | 0.02 | | 1 | Present Invention | |
| | | 11 | 87 | 0.04 | | 3 | Comparative Example | |
| | | 12 | 107 | 0.02 | | 2 | Present Invention | |
| | | 13 | 117 | 0.02 | | 1 | Present Invention | |
| | | 14 | 88 | 0.04 | | 4 | Comparative Example | |
| | | 15 | 115 | 0.04 | | 1 | Present Invention | |
| | | 16 | 87 | 0.03 | | 3 | Comparative Example | |
| | | 17 | 123 | 0.02 | | 1 | Present Invention | |

*1 standard

As shown in Table 1, the silver halide photographic materials containing the merocyanine dyes of the present invention have high sensitivity compared to the comparative samples and are greatly improved in variation of the sensitivity even under the conditions of high temperature and high humidity or in the presence of oxygen. The silver halide photographic materials containing the merocyanine dyes of the present invention are further excellent in that color is hardly left on unexposed areas after being processed. The silver halide photographic materials containing the merocyanine dyes of the present invention have high contrast and good storage stability as well as high sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one of compounds represented by general formula (I):

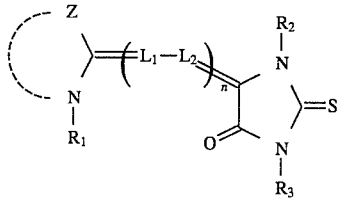

(I)

wherein Z represents a group of atoms necessary to form a five- or six-membered nitrogen-containing heterocyclic ring; $R_1$ represents an alkyl group; $R_2$ represents a hydrogen atom, an alkyl group, an alkenyl group, an aryl group, or a heterocyclic group; $R_3$ represents a pyrazinyl group; $L_1$ and $L_2$ each represents a methine group; and n represents 0 or an integer of 1 to 3.

2. A silver halide photographic material as claimed in claim 1, wherein in general formula (I), n is 0, 1 or 2.

3. A silver halide photographic material as claimed in claim 2, wherein in general formula (I), Z forms a benzoxazole nucleus.

4. A silver halide photographic material as claimed in claim 3, wherein in general formula (I), $R_1$ is a sulfoalkyl group and $R_2$ is a hydroxyalkoxyalkyl group or a hydroxyalkyl group.

5. A silver halide photographic material as claimed in claim 4, wherein in general formula (I), $R_3$ is an unsubstituted pyrazinyl group or a 5-methylpyrazinyl group.

* * * * *